US007422059B2

(12) United States Patent
Jelsma

(10) Patent No.: US 7,422,059 B2
(45) Date of Patent: Sep. 9, 2008

(54) FLUID INJECTION STIMULATED HEAVY OIL OR MINERAL PRODUCTION SYSTEM

(76) Inventor: Henk H. Jelsma, 17835 Kuykendahl, #208, Spring, TX (US) 77379

( * ) Notice: Subject to any disclaimer, the term of this patent is extended or adjusted under 35 U.S.C. 154(b) by 255 days.

(21) Appl. No.: 11/271,231

(22) Filed: Nov. 12, 2005

(65) Prior Publication Data

US 2007/0107902 A1 May 17, 2007

(51) Int. Cl.
*E21B 43/24* (2006.01)
*E21B 7/18* (2006.01)

(52) U.S. Cl. ..... 166/272.3; 166/272.7; 166/303; 175/424

(58) Field of Classification Search ..... 166/272.3, 166/272.7, 303; 175/424
See application file for complete search history.

(56) References Cited

U.S. PATENT DOCUMENTS 1,816,260 A * 7/1931 Lee ..... 166/303
4,880,067 A 11/1989 Jelsma
4,928,767 A 5/1990 Jelsma
RE33,660 E 8/1991 Jelsma
5,413,184 A 5/1995 Landers
5,853,056 A 12/1998 Landers
6,125,949 A 10/2000 Landers
6,189,629 B1 * 2/2001 McLeod et al. ..... 175/67
6,263,984 B1 7/2001 Buckman
6,668,948 B2 12/2003 Buckman
2007/0089879 A1 * 4/2007 Maguire ..... 166/259

* cited by examiner

*Primary Examiner*—David J. Bagnell
*Assistant Examiner*—Robert E Fuller
(74) *Attorney, Agent, or Firm*—James L. Jackson

(57) ABSTRACT

A method and apparatus for production of material from a subsurface earth formation being intersected by a wellbore that is lined with a well casing. After preparing the well casing by forming injection and production openings or removing a section of the casing to define a borehole interval, a plurality of lateral injection and production passages are formed that extend into the subsurface earth formation from the casing openings or borehole interval. Packers within the well casing define an injection compartment that is in communication with the lateral injection passages and a production compartment that is isolated from the injection compartment. Steam or other injection fluid is injected into the formation via an injection conduit extending from the surface to the injection compartment. Formation fluid migrating through the formation to the production passages is produced via a production conduit extending from the surface to the production compartment. For stabilization of the formation at the lateral injection and production passages a perforate liner is washed into place within each of the lateral passages.

12 Claims, 6 Drawing Sheets

FLUID INJECTION STIMULATED HEAVY OIL OR MINERAL PRODUCTION SYSTEM

BACKGROUND OF THE INVENTION

1. Field of the Invention

The present invention relates principally to the production of heavy oil or a selected mineral from subsurface crude oil bearing formations. More particularly, the present invention concerns a heavy crude oil production system and method employing steam injection into a plurality of lateral or radial injection passages extending from a like plurality of openings formed in the casing or primary wellbore or extending from an interval of the wellbore and into the formation after a section of well casing has been removed. The present invention also involves the production of formation fluid from a plurality of lateral or radial production passages that also extend from the wellbore and are in spaced relation with the injection passages. The scope of the present invention also concerns a method and apparatus for production of a wide variety of subsurface minerals from a subsurface earth formation, other than heavy crude oil, by means of chemical leaching, with or without steam injection.

2. Description of the Prior Art

The term "bores", as used herein, is employed to describe a plurality of lateral passages that extend from a wellbore into a subsurface earth formation of interest. It is not intended that this term be restricted solely to a rotary boring or drilling operation. Rather, it is intended that the terms "lateral or radial bores" and "lateral or radial passages" be considered synonymous. The term "bore" is intended to encompass any method of forming a passage in an earth formation extending laterally or radially from a wellbore. For example, lateral or radial passages are presently formed in subsurface earth formations by radial drilling, motor drilling or by hydraulic means such as hydraulic jet blasting or drilling. The terms "lateral" or "radial" are intended to identify passages that extend from a wellbore into an earth formation whether they are oriented in normal relation with the wellbore or extend upwardly or downwardly into the formation in relation to their intersection with or extension from the wellbore. The term "fluid" as used herein is intended to mean any liquid, vapor, steam, gas, chemical leaching agent or combination thereof that causes liberation of heavy oil or a mineral from a subsurface formation as a production fluid and prepares or stimulates it for transportation to the surface.

For the production of fluid, such as crude oil or minerals from wells intersecting subsurface production formations, the formation of multilateral passages from a main or principal, typically vertical wellbore has been accomplished by rotary drilling or reaming as set forth in U.S. Pat. Nos. 4,880,067, 4,928,767 and RE. 33,660 of Jelsma, or by hydraulic jet blasting or drilling as set forth in U.S. Pat. Nos. 5,853,056 and 6,125,949 of Landers and U.S. Pat. Nos. 6,263,948 and 6,668,948 of Buckman et al. Other related inventions from the standpoint of radial or lateral formation of passages extending from a primary well are presented by U.S. Pat. Nos. 4,497,381, 4,527,639 and 4,787,465 of Dickenson et al, U.S. Pat. Nos. 4,640,362, 4,765,173 and 4,790,384 of Schellstede et al

SUMMARY OF THE INVENTION

It is a principal feature of the present invention to provide a novel method for producing heavy oil or minerals from a subsurface production formation of the earth by injecting a fluid material, gaseous material or gas/liquid mixture into the earth formation via a plurality of lateral injection passages extending laterally or radially from a wellbore and producing the subsurface production formation via a plurality of lateral production passages also extending laterally or radially from the wellbore and being in spaced relation with the array of injection passages;

It is also a feature of the present invention to provide a novel method and apparatus to define an injection compartment and a production compartment within a wellbore being isolated from one another and each being in respective communication with an array of lateral or radial injection passages and production passages that extend from the wellbore into the subsurface formation;

It is another feature of the present invention to provide a novel method for producing heavy oil from a subsurface oil bearing earth formation by injecting steam into the subsurface oil bearing earth formation from a source at the surface via an injection conduit extending to a compartment within the well which is in communication with a plurality of lateral injection passages extending laterally or radially from a wellbore and producing the heavy oil production formation by means of a plurality of lateral production passages extending radially from the wellbore to a production compartment within the well that is isolated from the injection compartment; and It is also a feature of the present invention to provide a novel method for producing heavy oil or minerals from a subsurface oil bearing earth formation either employing lateral injection and production passages that extend into the earth formation from openings or windows that are formed in the open hole or the casing of the well or which extend from a borehole interval resulting from removal of one or more sections of the well or casing or open hole at or near the production formation.

Briefly, the various objects and features of the present invention are realized through the provision of a method and system for production of subsurface constituents such as heavy oil or minerals that is energized for production by the injection of a fluid, gas or fluid/gas constituent into the subsurface formation under pressure. The injection fluid may be steam for heating and energizing heavy viscous crude oil of the formation or a chemical leaching agent for leaching of desired minerals from the formation. A plurality of injection passages are formed in the production formation and extend from the wellbore and are arranged in substantially radial relation. The injection passages may extend from openings or windows that are blasted, milled, cut or otherwise formed in the well casing or in the alternative may extend from an open hole or from the wellbore where a section of the well casing has been removed, such as by a casing milling operation. The injection passages are in communication with an injection compartment within the well or which is typically isolated by packers and an injection conduit extending from the surface through the well or casing is also in communication with the injection compartment.

A plurality of lateral production passages are formed in the subsurface formation from the wellbore and are spaced from the injection passages. The lateral production passages are in communication with a production compartment within the well or casing which is isolated from the injection compartment, such as by means of one or more packers. A production conduit extends from the surface through the well or casing to fluid handling equipment at the surface. The production conduit is also in communication with the production compartment via openings or windows in the well or casing or via an interval that exists due to the removal of one or more sections of the well casing.

When the production constituent is heavy oil, steam from a source as the surface is injected into the injection compartment via the injection conduit and enters the production formation via the plurality of lateral injection passages. The steam is driven into the formation by steam pressure and causes heating of the heavy oil, thus reducing its viscosity and enabling it to migrate or be forced to flow through the formation by steam pressure. The radiating production passages are arranged to receive the heated heavy oil from the formation and conduct it to the production compartment within the well or casing. A production conduit extending from the production compartment to the surface and having any one of a number of suitable downhole pumping systems conducts the heated and less viscous heavy oil, any liberated natural gas and any water from the formation or condensed from the steam, to production fluid handling equipment that is located at the surface.

When the production constituent is a mineral that is capable of being released for the formation by chemical leaching a chemical leaching agent is pumped from a source at the surface and is conducted into the formation via the injection conduit, injection compartment and the array of radiating injection passages that are generally located above the producing lateral passages.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic illustration of the lower portion of a well, intersecting a production formation and having a system for injecting steam and/or chemical constituents into the formation via a plurality of radial passages extending from openings in the casing of a primary wellbore or extending from an open hole wellbore and producing the well via a production conduit of the well;

FIG. 2 is a schematic illustration similar to that of FIG. 1 and showing a well for steam or chemical injection via radial passages and another well having similar lateral or radial passages for production of the formation;

Figure 3:
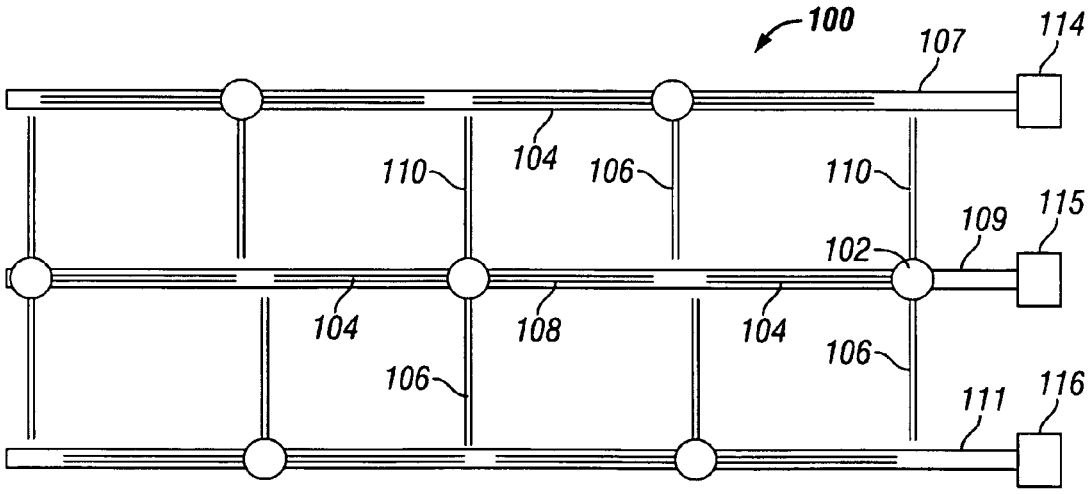
Figure 4:
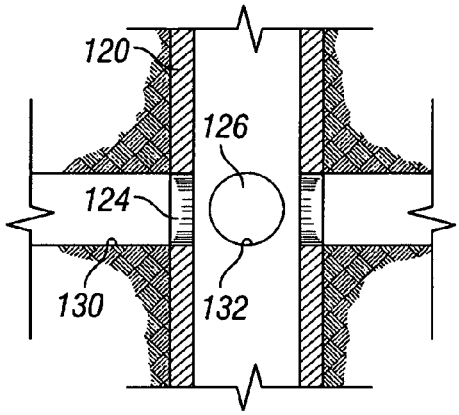
Figure 5:
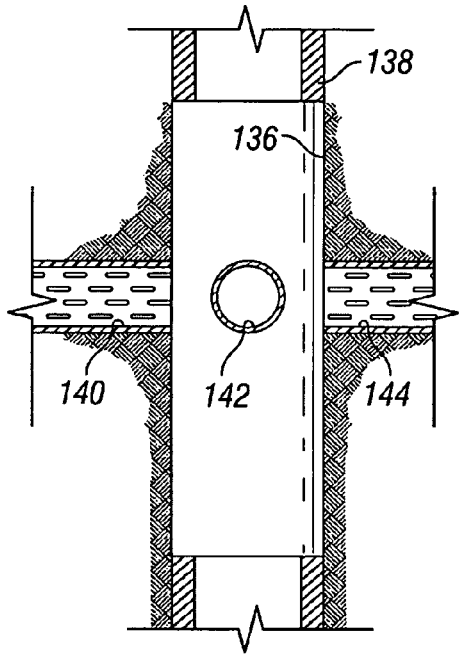
Figure 6:
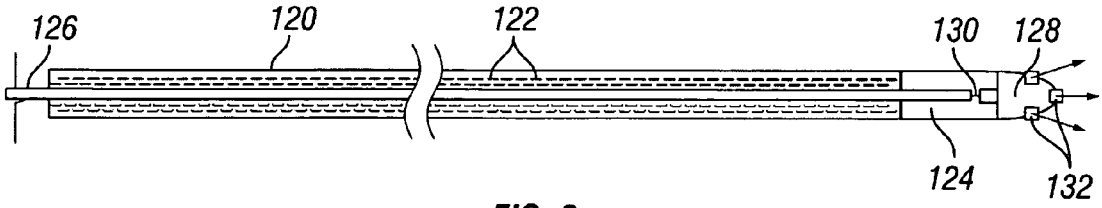
Figure 7:
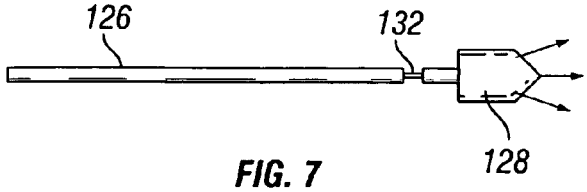
Figure 9:
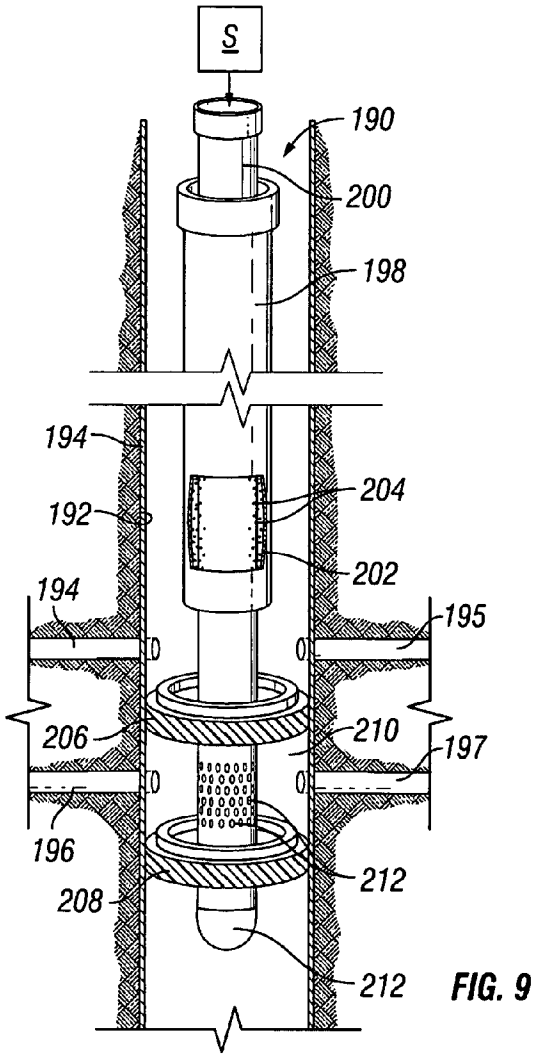
Figure 8:
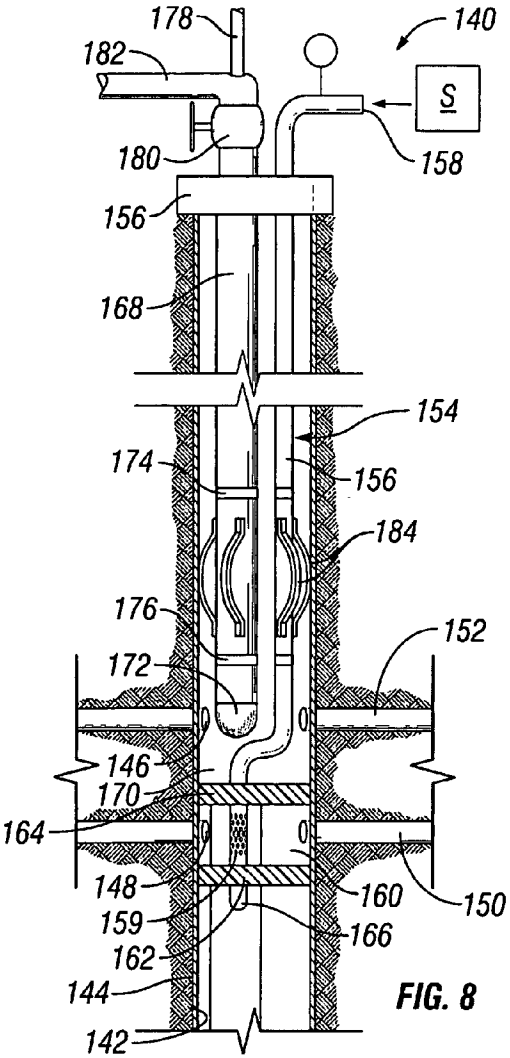
Figure 11:
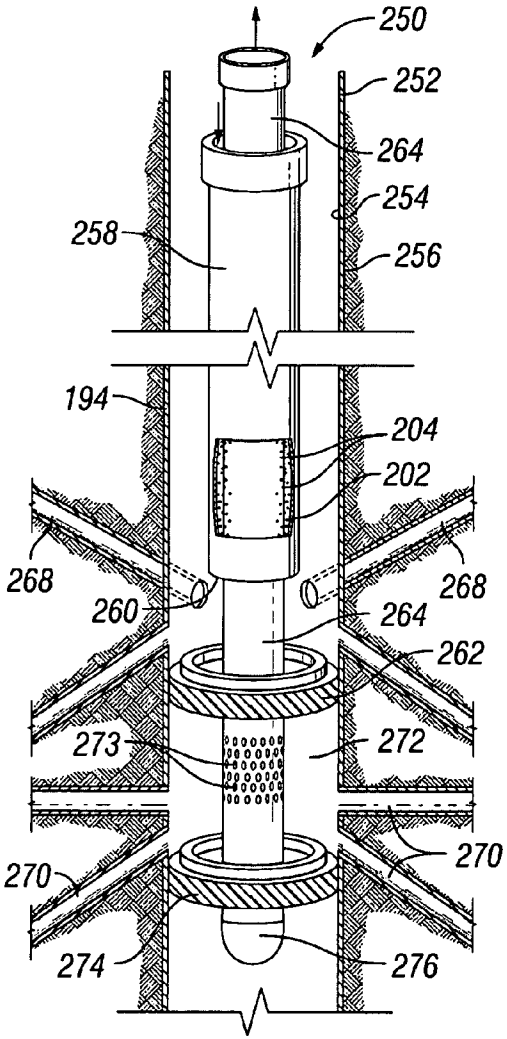
Figure 10:
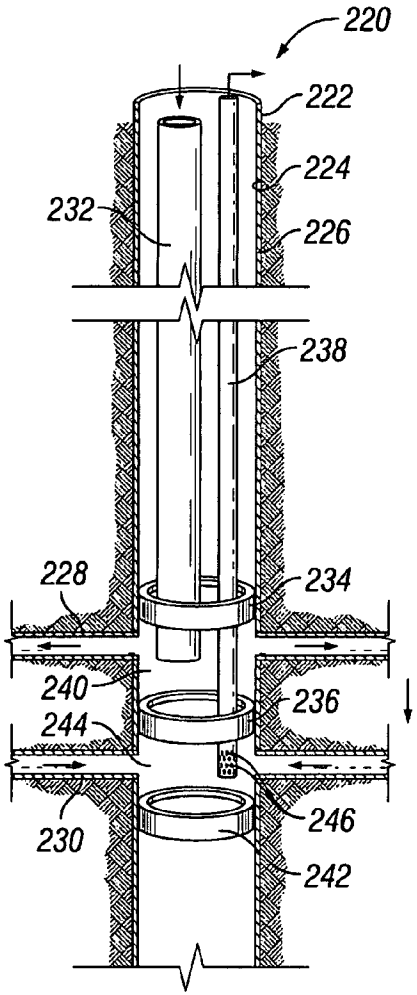
Figure 12:
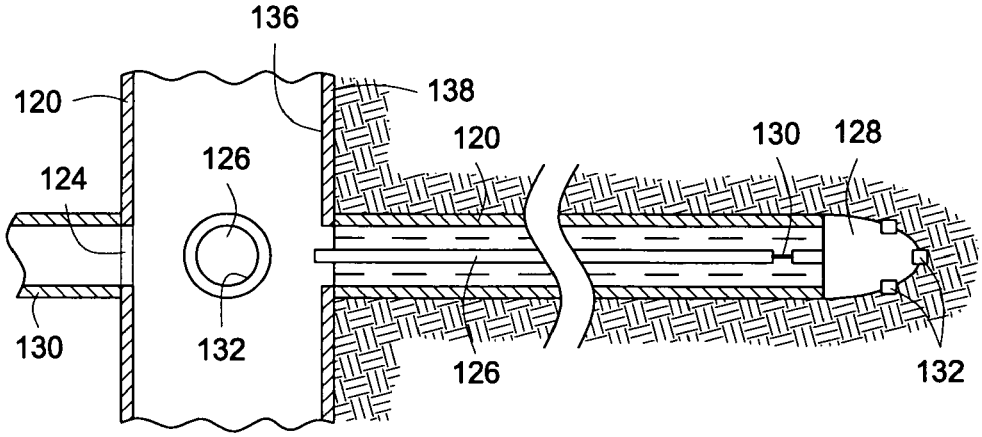
Figure 13:
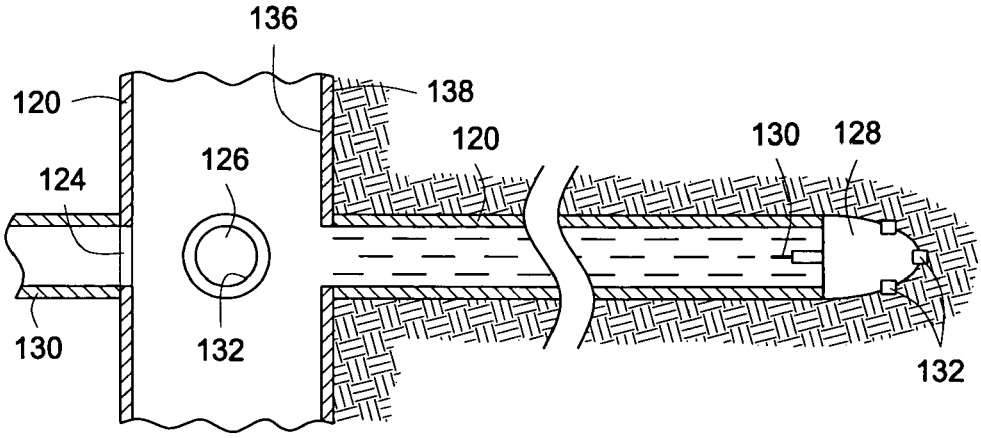

FIG. 3 is a schematic illustration in plan, showing a mineral production field having a plurality of well bores each having a plurality of lateral steam or chemical injection passages located in or near a production formation and having collection bores extending laterally through a formation and having intersection with headers that collect the formation fluid and permit the formation fluid to be collected and produced;

FIG. 4 is a partial sectional view of a well showing openings or windows in the well or casing and with lateral passages extending into an earth formation from the openings or windows of the casing or from an open wellbore or from a non-cased section of the well;

FIG. 5 is a partial sectional view of a well showing a cased wellbore with an open hole or having a section of the well casing removed to expose an interval of an earth formation and showing lateral mineral leaching passages or passages provided with slotted post jetting liners and extending from the wellbore into the earth formation from the wellbore at the exposed interval;

FIG. 6 is a sectional view of a liner washing assembly for post jetting hole stabilization particularly for mineral leaching and having a flexible slotted liner that is preferably composed of polyvinyl chloride or a polymer material having similar characteristics;

FIG. 7 is a sectional view showing the liner washing assembly of FIG. 6 and illustrating an over-pull release assembly permitting separation of a washing flow-line from a jet head that is designed to wash the liner into a previously jet formed lateral passage and to remain within the lateral passage along with the slotted liner;

FIG. 8 is a sectional view of a heavy oil production system embodying the principles of the present invention having a downhole pump mechanism and representing the preferred embodiment of the invention;

FIG. 9 is a sectional view of a heavy oil production system representing an alternative embodiment of this invention wherein a downhole pump is not employed and movement of production fluid from the formation and through the production conduit is responsive to the pressure of the injected fluid medium;

FIG. 10 is a sectional view of a mineral leaching system employing the principles of the present invention and showing a well construction adapted for injection of mineral leaching agent into an upper array of lateral formation passages and showing collection of production fluid from a lower array of lateral formation passages;

FIG. 11 is a sectional view of a mineral leaching system also employing the principles of the present invention showing mineral production by injection of chemical leaching agent into a production formation via an upper array of lateral formation passages and collection and production of the mineral and residual leaching agent via a lower array of lateral formation passages;

FIG. 12 is a partial sectional view of a well and showing the liner washing assembly of FIG. 6, with its washing fluid supply conduit and washing head in place within a lateral passage of FIG. 5, with the passage liner having been pulled into place within the lateral passage formed by washing fluid exiting the hydraulic jet nozzles of the washing head and further showing the over-pull release mechanism prior to its release; and FIG. 13 is a partial sectional view of the well shown FIG. 12 and showing the passage liner and washing head remaining in place within the lined lateral passage after release of the over-pull release mechanism and withdrawal of the washing fluid supply conduit.

DETAILED DESCRIPTION OF PREFERRED EMBODIMENT

Figure 1:
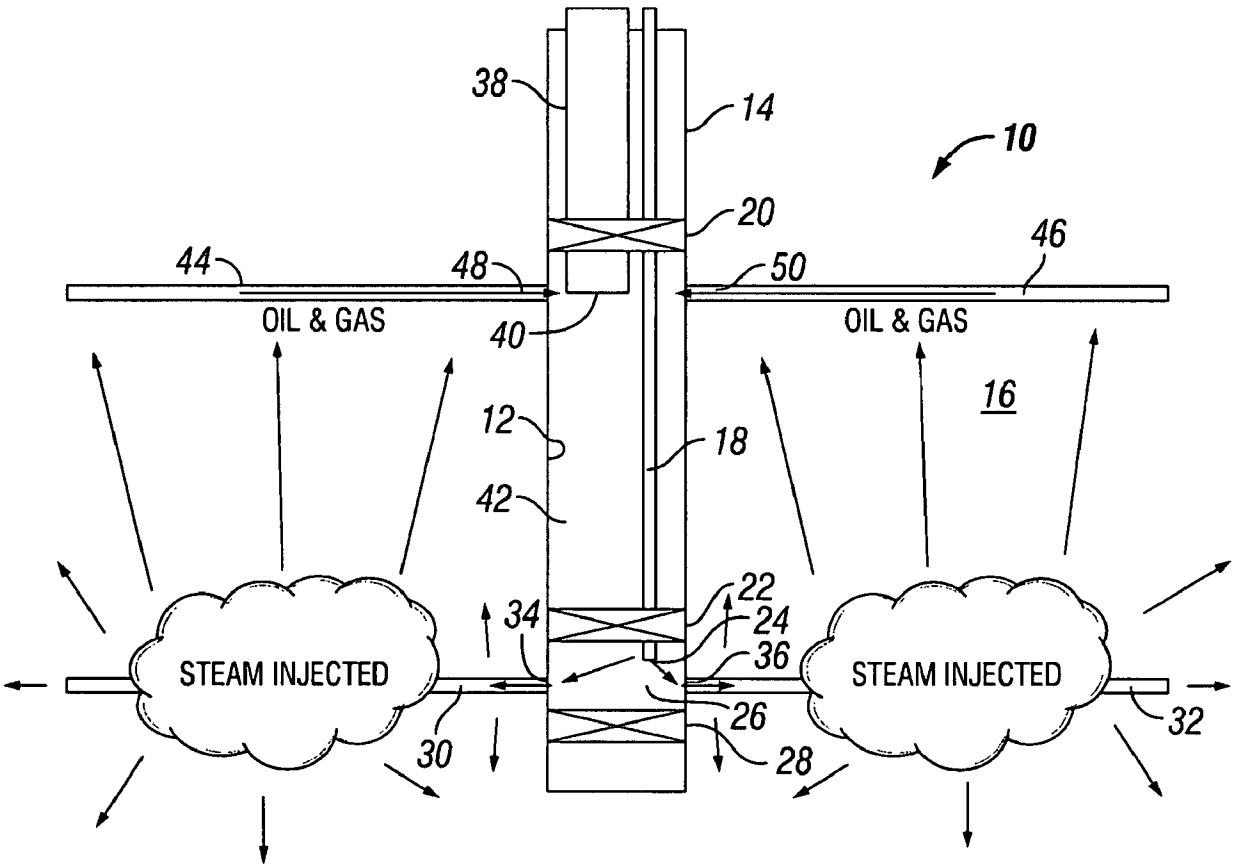

Referring now to the drawings and first to FIG. 1, a subsurface formation production system is shown generally at 10 and includes one or more primary wellbores 12 that are lined with a string of well casing 14. The primary wellbores 12 intersect a subsurface production formation 16 from which heavy viscous crude oil and natural gas are to be produced or which contains mineral constituents that can be produced by a chemical leaching process.

An injection tubing string 18 extends from the surface through the well or casing 14 and is secured in place by packers 20 and 22 or by any other suitable means for support and orientation thereof within the wellbore. The lower, open end 24 of the injection tubing string 18 is in communication with an injection compartment 26 within the well or casing which is isolated such as by packers 22 and 28 that establish sealing within the well or casing.

Figure 2:
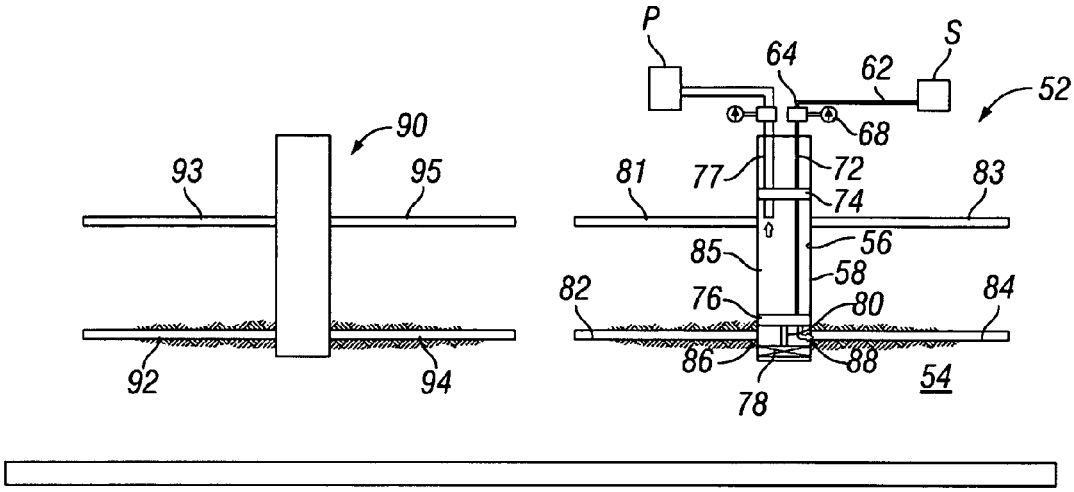

From the isolated injection compartment 26 extend an array of laterally oriented injection passages or passages 30 and 32 that are formed within the production formation 16 and extend from the wellbore wall or from a like plurality of openings or windows 34 and 36 that are formed in the well or casing 14 by a suitable drilling, milling or cutting tool or by any other suitable means. In the case of heavy crude oil production from the subsurface production formation 16, steam from a suitable source "S" located at the surface as shown in FIG. 2 is typically injected through the injection tubing string 18 into the injection compartment 26 of the well or casing 14. From the injection compartment 26 the steam enters the array of injection passages 30 and 32 and enters the subsurface production formation where it heats the heavy crude oil and reduces its viscosity and also pressurizes the production formation. The formation pressure induced by the pressure of the steam causes the heated and less viscous crude oil to migrate through the formation toward a lower pressure zone where it can be acquired and produced. In most cases a downhole pump is provided for pumping the collected production fluid to the surface; however in many cases production of the well is caused by injection pressure or steam pressure.

While only two radially or laterally oriented injection passages 30 and 32 are shown in FIG. 1, it will be apparent that any suitable number of the injection passages or bores may be formed, as is evident from the pattern of the subsurface production field of FIG. 3. The subsurface production field of FIG. 3 is designed particular for application of the principles of the present invention to mining operations by injected chemical leaching, with the leaching medium being injected into an upper array of lateral passages and with the production fluid collected by a lower array of lateral passages. Alternatively the production system may be reversed, with the chemical leaching fluid being injected into a lower array of lateral passages and the production fluid being collected by an upper array of lateral passages. A similar field pattern may also be utilized for the production of heavy crude oil by steam injection or by injection of any other gas, liquid or gas/liquid mixture to establish a driving influence to cause migration of the heavy crude oil through the formation to the production laterals. Though the injection passages may be formed through the use of various commercially available processes, to minimize the cost of preparing a well for production according to the principles of the present invention it is desirable to form a desired number of lateral passages through the use of equipment permitting all of the lateral passages to be formed during a single run of an appropriate lateral bore tool into the well. A system for single run formation of multiple lateral passages for steam and/or chemical injection and for well production preferably employs the subject matter of U.S. patent application Ser. No. 11/348,794 of Henk H. Jelsma, filed on Feb. 7, 2006 and entitled Method and Apparatus for Single-Run Formation of Multiple Lateral Passages From a Wellbore, which Application is incorporated herein by reference for all purposes. In many applications, to minimize the potential for sloughing of formation material into previously jetted lateral passages it is desirable to conduct post jetting liner washing operations where a perforate i.e., slotted liner is washed into place to provide formation support and to also provide for injection of fluid and provide for flow of formation fluid to the wellbore for production.

For production of the well, a production tubing string 38 extends from the surface through an open hole or through the casing string 14 and is secured by the packer 20 or by any suitable anchor device. The lower open end 40 of the production tubing string extends below the packer 20 and is open to a production compartment 42 within the well or casing 14 that is isolated by the packers 20 and 22. Typically, a pump will be located to pump collected formation fluid from the production compartment and through the production tubing to the surface; however in some cases the formation pressure, being enhanced by steam or injected fluid pressure will cause flow of the production fluid to the surface to fluid handling equipment at the surface. A plurality of lateral production passages or bores, two of which are shown at 44 and 46, extend into the production formation 16 from openings or windows 48 and 50 that are formed in the well or casing. The production passages may be un-lined as shown in FIG. 4 or lined by a flexible perforated liner as shown in FIG. 5 depending on the characteristics of the production formation. The lateral production passages 44 and 46 may also be formed by single run operation of the lateral bore tool that is used to form the lateral injection passages 30 and 32. The lateral production passages 44 and 46 are open to the production compartment 42 of the well or casing. As mentioned above, for heavy oil production the heat and formation pressure induced by the pressure of the steam causes the heated and less viscous crude oil to migrate through the formation to the lateral production passages 44 and 46 which conduct the produced oil and gas through the openings or windows 48 and 50 into the production compartment 42 of the well casing. When a pump is not employed, the crude oil and gas is then forced by the formation pressure into the production tubing 38 which conducts it to the surface where it is then received by surface equipment "P" for gas separation and for liquid storage, handling or transportation.

Referring now to the schematic illustration of FIG. 2, and to the schematic production field illustration of FIG. 3 heavy oil or other mineral constituents may be produced from a production field by employing injection wells and production wells or wells that employ both injection and production equipment. At the right hand portion of FIG. 2 an injection and production well system is shown generally at 52 and comprises a primary wellbore 56 which intersects a subsurface production compartment 54. The primary wellbore 56 is open or is lined with a string of well casing 58. It should be understood that for mineral production by chemical leaching activity the chemical leaching fluid is typically injected into an upper array of lateral passages and the leached mineral and leaching fluid forming the production fluid is collected by a lower array of lateral passages. From a source "S" of steam or chemical injection fluid, an injection supply line 60 conducts steam or chemical constituents to a control valve 64 which is monitored by pressure and/or temperature gauge 68. An injection line 72 extends from the injection fluid control valve 64 through the open hole or casing or open hole 58 and is secured and positioned within the casing string by packers 74 and 76 or by any other suitable means for anchoring and positioning the lower end thereof with respect to the well or casing. When an anchoring and sealing packers 76 and 78 are employed the packers will effect a seal within the hole and will establish a sealed injection compartment 80 within the well or casing. The injection line 72 is arranged to inject steam or chemical constituents into the sealed or isolated injection compartment 80 and thus cause the steam to be injected into the formation via the lateral injection passages.

Lateral injection passages 82 and 84 extend into the production formation from openings or windows 86 and 88 that are formed in the well or casing and serve to conduct injected steam or chemical constituents from the sealed or isolated injection compartment 80 into the production formation for producing the formation for oil and gas or for recovery of other minerals, such as by means of chemical leaching. It should be borne in mind that for steam activated production of heavy oil the steam is injected into a lower array of lateral passages and the production fluid is collected by an upper array of lateral passages. Conversely, for mineral production the chemical leaching constituent is injected into an upper array of lateral passages and the leached mineral and residual leaching fluid composing the production fluid is collected by a lower array of lateral passages. Lateral production passages 81 and 83 also extend from the wellbore into the production formation and are in spaced relation with the injection passages 82 and 84 as shown. The lateral production passages are in communication with a production compartment 85 which is isolated within the wellbore by the packers 74 and 76. A production conduit 77 is open to the production compartment 85 and serves to conduct produced fluid to production equipment "P" which is located at the surface. Especially when the production conduit system is provided with a pump to pump the produced fluid to the surface a control valve 79 and pressure gauge 81 may be employed for production control and monitoring.

One or more adjacent wells of the production field, such as shown generally at 90 in the left portion of FIG. 2, are likewise provided with lateral steam or chemical injection passages 92 and 94 and production passages 93 and 95 that extend from the well into a subsurface formation of interest. For production of heavy crude oil or minerals, the steam or chemical constituents injected into the formation via the injection well system 52 can be caused to migrate through the formation to an adjacent production well 90. The production components of well 90 will then incorporate one or more injection and production tubing strings that are sealed within the well or casing by packers and, if needed, are secured and positioned within the well or casing by anchor devices or packers that also serve the function of providing for anchoring and orientation of the injection and production tubing strings.

Referring now particularly to FIG. 3 the schematic illustration in plan presents a portion of a production field arrangement, shown generally at 100, that is particularly suited to the production or mining of mineral constituents by means of chemical leaching. It should be borne in mind, however, that a production field for heavy oil and natural gas may be of similar nature. The production field of FIG. 3 incorporates a plurality of primary, typically vertical wells 102 that extend from the surface to one or more subsurface formations of interest and are typically at least partially lined with a string of well casing. Multiple lateral or radial passages 104, 106, 108 and 110 extend laterally into the production formation from openings or casing windows that are formed at one or more desired casing depths. Steam, in the case of heavy oil, or chemical constituents, in the case of chemical leaching, is caused to flow from one or more sources "S" to one or more of the wells 102 and is injected into the formation via the lateral or radial passages that extend into the formation from the wells in the manner discussed above in connection with FIGS. 1 and 2. Each of the wells may be provided with both injection and production equipment as shown in FIG. 1 or there may be injection wells and production wells as shown in FIG. 2.

For the production of minerals, lateral collector passages 107, 109 and 111 and typically formed in the lower part of the subsurface mineral containing formation and are typically oriented laterally. The collector passages are in communication with collector receptacles 114, 115 and 116 that receive and collect the leached chemical materials together with the residual leaching fluid. The collected fluid is then recovered from the collector receptacles by means of pumps or any other suitable system for recovering the fluid and then transmitting it to suitable handling or processing equipment which is located at or near the earth surface.

Referring now to FIGS. 6 and 7, in cases where the subsurface production formation requires support to minimize the potential for sloughing of the formation material into the jetted lateral passages, the present invention also contemplates employment of equipment and processes for installing formation supporting liners which are preferably perforated or slotted to provide for flow of injected fluid from the lateral passages into the production formation or flow production fluid into the lateral passages for production. As shown in FIG. 6 a slotted tubular liner is shown generally at 120, which is preferably composed of polyvinyl chloride or any one of a number of polymer materials having similar characteristics. The tubular liner is provided with a multiplicity of flow slots or perforations 122 that are located along substantially the entirety of its length. The slotted formation support liner is of sufficient flexibility to be passed through the principal typically vertically oriented wellbore and to become bent as it is diverted into a lateral passage that extends from the wellbore into the formation.

After lateral passages have been formed in the formation such as by a drilling, hydraulic jetting or hydroblasting operation a jet washing assembly 124 is connected to the leading end of the liner and a fluid supply conduit 126 is connected in fluid supplying relation with a jet washing head 128 by means of an over-pull release mechanism 130. The fluid supply conduit 126 is typically formed by flexible tubing that can be run into the well and bend to transition into the lateral passages that extend from the wellbore. The jet washing head 128 is provided with a plurality of hydraulic jet nozzles 132 that are arranged to direct jets of high velocity fluid, such as water, against the formation within the lateral passages. The jet nozzles 132 of the jet washing head 128 may be arranged to develop a reaction force which drives the jet washing head 128 and the liner 122 forwardly from the wellbore and into a lateral passage responsive to the jet reaction that occurs at the jet washing head. After sufficient jet washing has occurred to position the entirety of the formation supporting slotted liner 120 within a lateral passage, a pulling force is applied to the fluid supply conduit 126, causing the over-pull release mechanism to actuate, releasing the connection of the fluid supply conduit 126 with the jet washing head 128. When this occurs the fluid supply conduit 126 is simply withdrawn from the slotted liner and is retrieved from the well. This process is repeated until the desired lateral passages have all been provided with a formation supporting liner. Thereafter, the liners will prevent sloughing of the formation material into the lateral passages and the slots or perforations of the liner will permit efficient flow of injection fluid into the formation and will permit the flow of production fluid from the formation and into the lateral passages.

Referring now to FIG. 8 which shows the a steam energized heavy oil production system preferred embodiment of the present invention generally at 140 a borehole is shown at 142 which is lined with a casing 144 in typical fashion. Upper and lower sets of openings or windows 146 and 148 are provided in the well or casing or in the alternative, portions of the casing may be blasted, milled or otherwise formed to expose one or more desired intervals of the borehole. Arrays of lateral injection passages 150 and lateral production passages 152 are formed in vertically spaced relation within the surrounding production formation. Each of the vertically spaced arrays of lateral passages may have any desired number of lateral passages that extend into the formation to be produced. These lateral passages may also be lined by a slotted liner if desired.

A production assembly shown generally at 154 is installed within the well or casing and may be supported by a casing head 156 which is mounted to the upper end of the casing at or above surface level. The production assembly 154 incorporates an injection conduit 157 receiving steam or other injection fluid from a source "S" and having an injection supply conduit 158 which extends downwardly within the well casing. The injection supply conduit is open by means of perforations 159 of a portion of the injection conduit to an injection chamber or compartment 160 that is located between spaced packers 162 and 164. The injection conduit terminates at a bullnose 166 that is located below the lower packer member 162. The lower end portion of the injection conduit is offset so that the tubular portion that is located between the packer members is substantially centralized within the well casing.

A production conduit 168 also extends from the casing head 156 through the well or casing and it positioned with its lower terminus located above the upper packer member 164 and thus within a production chamber or compartment 170. The upper array of lateral production passages 152 are located to deliver collected production fluid into the production chamber 170. A pump 172 is provided at the lower portion of the production conduit 168 and is provided with upper and lower valve members 174 and 176 which open and close responsive to differential pressure. The pump 172 may comprise any one of a number of suitable downhole pump systems that are energized a pump jack, by electric power or by any other suitable means. A production discharge conduit 182 extends from the pump and serves to conduct produced well fluid to the usual fluid receiving and handling equipment at the surface for gas/water separation and conducts the produced crude oil to a suitable facility for storage and handling.

The steam energized heavy oil production system 140 is positioned within the well or casing 144 by means of one or more centralizers 184 thus positioning the lower end of the injection conduit in substantially centralized position within the injection compartment 160 and also positioning the packers 162 and 164 in position for efficient sealing engagement with the inner surface of the well or casing. If desired, the injection conduit and the production conduit may be connected in spaced relation by means of connecting devices along the length thereof so that the conduits will not have any tendency to become twisted between the surface and the production compartment.

Another embodiment of the present invention is shown generally at 190 in FIG. 9 wherein a wellbore 192 is shown to have a well casing 192 that is provided with upper and lower arrays of openings or windows 194 and 196 from which arrays of injection and production passages are formed within the subsurface formation. In a typical shallow well the well casing may have an internal diameter of 4½ inches. The well production system 190 has a string of production tubing 198 which extends to the surface and may have an internal diameter of about 2⅞ inches or any variation thereof as desired. The injection tubing 200 extends from the surface through the production tubing 198 and is provided with a centralizer device 202 to engage the inner wall of the production tubing 198 and to maintain the production tubing centrally located therein. The production tubing 198 is perforated as shown at 204 to admit production fluid from the well casing. Upper and lower packers 206 and 208 are provided on the injection tubing 200 and engage the internal surface of the well or casing 194 and define an injection compartment 210 within the well or casing. The injection compartment is in communication with the lower array of injection passages 197 of the subsurface formation and thus provide for injection of steam or chemical injection fluid into the formation. A bullnose member 212 is located beneath the lower packer member 208 as is typical for packer installations. The injection tubing is open to the injection compartment 210 by means of a multiplicity of injection perforations 213.

Referring now to FIG. 10 an embodiment of the present invention is shown generally at 220 which is designed particularly for production of a subsurface earth formation by leaching of a selected mineral from the formation. Wells 222 drilled vertically or at any desired angle of inclination from the surface into the mineral production formation. The wells may be of the open hole variety, being defined by a wellbore 224 or the wellbore may be lined with a casing 226. Alternatively, a downhole section of the casing may be milled or otherwise removed, thereby leaving a section of open hole from which lateral passages are formed by any suitable means.

Upper and lower arrays of lateral passages 228 are formed from the wellbore or from openings or windows in the casing and extend laterally a suitable distance into the formation of interest. Each array of lateral passages is typically defined by from 2 to 4 lateral passages that are formed by rotary drilling, jet drilling, hydroblasting or by any other suitable means. If desired, each of the lateral passages may be lined with a slotted or otherwise perforated conduit that may be composed of polyvinyl chloride or any other suitable polymer material having equivalent properties. This perforated liner serves to stabilize the formation at the lateral passages and the perforations permit transfer of a leaching medium to the formation and permit collection of production fluid migrating through the formation to the production lateral passages.

An injection tubing or conduit 232 extends from the surface through the borehole or casing and has its lower end secured and sealed within the borehole or casing by means of a packer 234 which also serves to anchor the injecting tubing in place within the casing. The upper array of lateral passages 228, which are injection passages for the chemical leaching agent, intersect the wellbore below the packer 234. An intermediate packer 236 is set within the borehole or casing and provided for anchoring and sealing of the lower end of a production tubing or conduit 238 that extends from the surface through the wellbore or casing. The upper packer 234 and the intermediate packer 236 establish an injection compartment or compartment 240 that is in communication with the upper array of lateral passages 228. For production of minerals by chemical leaching, a chemical leaching agent is injected into the injection compartment or compartment 240 of the well via the injection conduit 132 and is then conducted to a selected region of the upper portion of the mineral production formation by means of the upper array of lateral passages 228. The chemical leaching agent then migrates downwardly through the mineral production formation dissolving the desired mineral of interest carrying the leached mineral with it.

A lower packer 242 is set within the borehole or casing and cooperates with the intermediate packer 236 to establish a collection or production compartment 244 within the wellbore or casing which is isolated from the injection compartment 244 and other regions of the well. The collection or production compartment 244 of the well is in communication with the lower array of lateral passages 230 so that the residue of the chemical leaching agent and the leached mineral that it carries is collected by the lower array of lateral passages 230 and is conducted to the collection or production compartment by the lateral passages. The lower end of the production conduit 238 is perforated or provided with a screen as shown at 246 thus permitting the production fluid to be conducted upwardly through the production conduit to the surface, typically under the influence of any suitable type of pump system. The production conduit is in communication with fluid handling equipment that is provided at the surface.

Referring now to FIG. 11 another embodiment of the present invention is shown generally at 250 which is also particularly designed for production of one or more selected minerals from a subsurface production formation. One or more wells 252 are drilled vertically or at any desired angle of inclination from the surface into the mineral production formation. The wells may be of the open hole variety, being defined by a wellbore 254 or the wellbore may be lined with a casing 256. Alternatively, a downhole section of the casing may be milled or otherwise removed, thereby leaving a section of open hole from which lateral passages are formed.

An injection conduit 258 extends from the surface of the well to a depth at or near the production formation of interest. The lower open end 260 of the injection conduit 258 is located above an upper packer through which the lower end portion of a production conduit 264 extends. The lower packer also serves to position, anchor and seal the lower end portion of the production conduit 264. The production conduit extends through the injection conduit 258, is of smaller external diameter as compared with the internal diameter of the injection conduit, thus defining an annular flow path for the injected chemical leaching agent. One or more centralizers 266 are interposed in the annular space between the injection and production conduits and serve to centralize the production conduit within the injection conduit. The lower end portion of the injection conduit may be perforated or may be provided with a screen to permit efficient flow of the injected fluid past the centralizer and into the wellbore or casing.

Above the upper packer member 262 the wellbore or casing is in communication with an array of lateral injection passages that extend from the wellbore or casing into the formation of interest. Injected chemical leaching agent flowing from the injection conduit enters the wellbore or casing above the upper packer member and is conducted by the multiple lateral passages into the formation where it reacts with the selected mineral and converts the selected mineral to a liquid state. The chemical leaching agent then migrates downwardly through the mineral containing formation and dissolves the mineral constituent and the mixture of chemical leaching agent and mineral constituting the production fluid is collected by a lower array of similar lateral collection or production passages 270. The collected mixture is then conducted to a compartment or chamber 272 within the wellbore and between the upper packer 262 and a lower packer 274 that is also located within the wellbore or casing and is positioned below the intersection of the collection or production passages 270 with the wellbore. The lower part of the production conduit within the compartment or chamber 272 is conducted into the production conduit by means of perforations or a screen as shown at 273 The collected production fluid is then removed from the collection chamber or compartment 272 by any one of a number of suitable pumping mechanisms and is delivered to production fluid handling equipment at the surface. Below the lower packer 274 is provided a bullnose structure 276 as is typical of lower packer installations.

The present invention is practiced according to the following method: Lateral or radial passages are formed within a subsurface formation by drilling or by hydraulic jet blasting from openings or windows that are formed in the well or casing at a desired depth and desired orientation. In the alternative, one or more sections of the well or casing at the depth of the production formation may be removed such as by a milling operation. Preferably a "single-run" lateral passage forming tool is run into the well or casing and is set at a desired orientation and anchored either at the bottom of the wellbore or at a desired depth within the wellbore, such as by means of packers and anchors. The single-run lateral passage forming tool may also be selectively moved to two or more vertically spaced locations within the well or casing after the formation of a plurality of multiple lateral passages, without having to retrieve the tool from the well. This "single-run" feature significantly minimizes the labor and equipment operation time that is required to prepare a well for injection of steam or chemical constituents or for production of fluid from the formation that is intersected by the well.

Following multilateral passage or bore forming activity, for support of the formation to minimize the potential for blockage of the lateral injection and production passages in the formation, a slotted or perforated liner composed of flexible polyvinyl chloride or any one of a number of suitable polymer materials having similar characteristics is washed into place within each of the lateral passages. When the liner is properly positioned within the lateral passages a pulling force is applied to the flexible washing fluid supply conduit 126 to release the over-pull release mechanism of the jet head, thus leaving the liner and jet head in position within each of the lateral passages. After this has been done, an injection tubing string adapted for communication with a source of steam or leaching chemical constituents is positioned within the well with its lower open end in communication with an isolated injection compartment within the well casing or wellbore with which radial injection passages of the formation are also in communication. The injection compartment is isolated by packers or by any other suitable means. The steam pressure or injection pressure within the injection compartment causes the steam or chemical constituents to be injected into the formation from the lateral or radial passages, thus treating and pressurizing the production formation and causing migration of the treated fluid within the formation toward the lateral production passages. The lateral production passages are situated relative to the injection passages such that the migrating fluid of the formation is collected by the production passages and is then conducted to the production compartment within the primary wellbore. From the production compartment the fluid is conducted to fluid handling equipment at the surface via the production tubing either under the influence of a downhole pump or by the pressure of the injected fluid medium.

Referring specifically to FIG. 4, the sectional view illustrates a wellbore 120 being lined with a well casing 122. Openings shown at 124, 126 and 128 are formed in the well casing by any suitable means and radial passages or passages 130, 132 and 134 extend into an earth formation of interest from the openings or windows of the well casing.

As shown in FIG. 5, a wellbore is shown at 136 to be lined with a well casing 138 in conventional manner. A section or interval of the well casing is shown to have been removed such as by means of a milling or similar operation, thus exposing the wellbore wall at or near the production formation. Lateral passages or bores 140, 142 and 144 are shown to extend from the wellbore 136 into the subsurface earth formation. A like set of lateral passages or bores, either for injection or production will be located above or below the lateral passages shown in FIGS. 4 and 5. The vertical spacing of the lateral injection and production passages will be determined by the thickness or other factors of the production formation.

In the event the production formation contains a desired mineral which is intended to be produced by a chemical leaching process, the well construction and apparatus will generally take the form that is shown in FIGS. 10 and 11. Production of wells for chemical leaching of minerals is typically conducted by injecting a chemical leaching agent into a formation via an upper of lateral passages that extend from the well and into an upper part of the production formation. An injection chamber is defined by packers within the wellbore or casing and the leaching agent is pumped from the surface through an injection conduit that delivers the chemical leaching agent to the injection chamber and thence from the injection chamber into the formation by the upper array of lateral passages. The injected chemical leaching agent dissolves the selected mineral as it migrates downwardly through the formation. At the lower part of the formation the mixture of leaching agent and mineral forming a production fluid is collected by a lower array of lateral passages that also extend into the formation from the wellbore or casing. The production fluid collected by the lower array of lateral passages is conducted into a production chamber the wellbore or casing where it is then removed from the production chamber and conducted to the surface by a production conduit under the influence of a suitable pump or any other means for causing flow of the production fluid from the production chamber through the production conduit to the surface.

For chemical leaching of minerals from a formation or for production of oil from a formation the well is provided with injection and production conduits. These conduits may extend through the borehole or casing in side-by-side relation as shown in FIG. 10 or in concentric arrangement as shown in FIG. 11. In either case, the conduits define an injection flow passage to conduct injection fluid, such as a liquid, vapor, gas or a combination thereof from the surface to a selected chamber or compartment of the well which is in communication with a desired upper or lower array of lateral passages that extend from the wellbore or casing into the formation of interest. The conduits or conduit arrangement shown in FIGS. 10 and 11 also define a production passage extending from a production chamber or compartment and upwardly to the surface where it is received by production fluid handling equipment located at the surface.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for production of material from a subsurface earth formation being intersected by a wellbore, comprising:

forming a plurality of lateral injection passages extending into the subsurface earth formation from the wellbore;

forming a plurality of lateral production passages extending into the subsurface earth formation from the wellbore, said plurality of lateral production passages being substantially vertically spaced from said plurality of lateral injection passages;

each of said lateral injection and production passages being formed by fluid jetting with a jet washing head having a perforate liner connected therewith and having a washing fluid supply conduit releasably connected with said jet washing head;

after jet washing the jet washing head and perforate liner to a laterally extended position with the perforate liner substantially completely lining the lateral passage stopping fluid jetting and releasing the washing fluid supply conduit from the jet washing head;

retrieving the washing fluid supply conduit, leaving the perforate liner and jet washing head within the lateral passage;

establishing an injection compartment within the wellbore, said injection compartment having communication with a source of injection fluid via an injection conduit;

establishing a production compartment within the wellbore being sealed from said injection compartment, said production compartment being in communication with fluid handling equipment at the surface via a production conduit;

injecting fluid from a source of injection fluid into said injection compartment and into the production formation via said injection passages, the injection fluid migrating through the production formation to said plurality of lateral production passages; and producing material and injection fluid from the subsurface formation via said plurality of lateral production passages and said production compartment and to the surface via said production conduit.

2. The method of claim 1, wherein said material of the subsurface formation being heavy oil and said injection fluid being steam, said method comprising:

injecting steam into the subsurface formation from a source of steam via said injection conduit, injection compartment and said plurality of lateral injection passages to render the heavy oil less viscous and to cause steam pressure induced migration of the heavy oil through the subsurface earth formation and to said plurality of lateral production passages; and producing the heavy oil from said production compartment to said production fluid handling equipment via said production conduit.

3. The method of claim 1, comprising:

forming a plurality of openings in the well casing; and forming said plurality of lateral injection and production passages within the subsurface earth formation from said plurality of openings.

4. The method of claim 1, comprising:

removing at least one section of said well casing to define one or more non-cased intervals; and forming said plurality of lateral injection and production passages within the subsurface earth formation from said one or more non-cased intervals.

5. A method for production of heavy and normally viscous crude oil from a subsurface earth formation being intersected by a wellbore lined with a well casing, comprising:

forming a plurality of injection and production openings in the well casing at predetermined locations for fluid injection and for heavy crude oil production;

forming a plurality of lateral injection passages extending into the subsurface earth formation from the plurality of injection openings;

forming a plurality of lateral production passages extending into the subsurface earth formation from the plurality of production openings, said plurality of lateral production passages being spaced from said plurality of lateral injection passages, each of said lateral injection and production passages being formed by causing washing fluid actuated lateral movement of a jet washing head having a perforate liner and washing fluid supply conduit connected therewith from the wellbore and into the subsurface earth formation, ceasing washing fluid supply when the lateral production passage has reached desired lateral penetration into the formation and separating and retracting said washing fluid supply conduit from said jet washing head and leaving said jet washing head and perforate liner within the lateral passage;

establishing an injection compartment within the wellbore, said injection compartment having communication with a source of steam via an injection conduit;

establishing a production compartment within the wellbore being sealed from said injection compartment, said production compartment being in communication with fluid handling equipment at the surface via a production conduit;

injecting steam from a source into said injection compartment and into the production formation via said injection conduit, injection compartment and said plurality of lateral injection passages, the steam heating the heavy viscous crude oil of the subsurface formation and reducing the viscosity of the heavy crude oil and causing migration of the heavy crude oil through the production formation to said plurality of lateral production passages and into said production compartment; and producing the heavy crude oil from the subsurface formation via said plurality of lateral production passages, said production compartment and said production conduit.

6. The method of claim 5, comprising:

setting at least one packer within said well casing and establishing said injection compartment, said injection conduit extending through said at least one packer and being open to said injection compartment; and setting at least one packer within said well casing and establishing said production compartment, said at least one packer isolating said production compartment from said injection compartment, said production conduit extending through said at least one packer and being open to said production compartment.

7. The method of claim 5, comprising:

forming a plurality of openings in the well casing; and forming said plurality of lateral injection and production passages within the subsurface earth formation from said plurality of openings.

8. The method of claim 5, comprising:

removing at least one section of said well casing to define one or more non-cased intervals; and forming said plurality of lateral injection and production passages within the subsurface earth formation from said one or more non-cased intervals.

9. A system for production of a material from a subsurface earth formation being intersected by a wellbore, comprising:

an array of lateral injection passages extending into the subsurface earth formation from the wellbore;

an array of lateral production passages extending into the subsurface earth formation from the wellbore, said array of lateral production passages being spaced from said array of lateral injection passages;

a perforate liner having a jet washing head attached thereto remaining within each of said lateral injection and production passages upon completion thereof;

an injection compartment within the wellbore;

a production compartment within the wellbore being isolated from said injection compartment, and being in communication with fluid handling equipment at the surface;

an injection conduit within the wellbore being in communication with said injection compartment; and a production conduit within the wellbore being isolated from said injection conduit and being in communication with said production compartment.

10. The system of claim 9 wherein the wellbore is lined with a well casing, said system comprising:

a plurality of injection openings and a plurality of production openings being defined at spaced locations within the well casing; and said array of plurality of lateral injection passages and said array of production passages extending within the subsurface earth formation respectively from said plurality of injection openings and said plurality of production openings.

11. The system of claim 9 wherein the wellbore is lined with a well casing, said system comprising:

at least one section of the well casing being removed to define at least one non-cased interval; and said plurality of lateral injection and production passages within the subsurface earth formation extending from said at least one non-cased interval.

12. The system of claim 9, comprising:

each of said washing heads having a plurality of washing jets and being hydraulically energized with flowing washing fluid to move said perforate liner laterally from said wellbore to a position substantially completely lining a lateral injection or production passage formed by said washing head; and during installation of each of said perforate liners a washing fluid supply conduit connected with a supply of washing fluid extending through said perforate liner and having releasable connection with said washing head.

* * * * *